United States Patent [19]

Hodate et al.

[11] Patent Number: 4,830,605

[45] Date of Patent: May 16, 1989

[54] COMBUSTION APPARATUS AND METHOD OF FORCIBLY CIRCULATING A HEATING MEDIUM IN A COMBUSTION APPARATUS

[75] Inventors: Tomoshi Hodate, Kasukabe; Haruyoshi Nitta, Yono, both of Japan

[73] Assignee: Kashiwa Co., Ltd., Tokyo, Japan

[21] Appl. No.: 158,675

[22] Filed: Feb. 22, 1988

Related U.S. Application Data

[60] Division of Ser. No. 933,120, Nov. 21, 1986, Pat. No. 4,743,195, which is a continuation of Ser. No. 717,018, Mar. 28, 1985, Pat. No. 4,662,839.

[30] Foreign Application Priority Data

Apr. 12, 1984 [JP] Japan ..... 59-73514
Apr. 25, 1984 [JP] Japan ..... 59-83303
May 31, 1984 [JP] Japan ..... 59-112100

[51] Int. Cl.[4] ..... F23D 19/00

[52] U.S. Cl. ..... 431/170; 432/58; 110/245

[58] Field of Search ..... 431/170, 7; 122/4 D; 110/245, 261, 263; 34/57 A; 432/58

[56] References Cited

U.S. PATENT DOCUMENTS 3,887,337 6/1975 Descamps et al. ..... 34/57 A
3,994,665 11/1976 Young ..... 431/11
4,021,193 5/1977 Waters ..... 432/58
4,096,640 6/1978 Krambrock et al. ..... 432/58
4,338,283 7/1982 Sakamoto et al. ..... 431/170
4,662,839 5/1987 Hodate et al. ..... 431/115

FOREIGN PATENT DOCUMENTS 2419586 11/1974 Fed. Rep. of Germany .
3011292 1/1981 Fed. Rep. of Germany .
154319 4/1982 Norway ..... 431/7
577144 6/1976 Switzerland .
2079173 1/1982 United Kingdom ..... 431/7

*Primary Examiner*—Samuel Scott
*Assistant Examiner*—Noah Kamen
*Attorney, Agent, or Firm*—Oblon, Fisher, Spivak, McClelland & Maier

[57] ABSTRACT

According to the invention, a combustion apparatus includes an upright type combustion chamber having a bottom, conduit means extending below and along the bottom of the combustion chamber and having a nozzle which passes upwardly through the bottom and opens into the combustion chamber, a ringed body supported in the combustion chamber with a gap formed between the lower edge of the ringed body and the bottom of the combustion chamber, air blasted from the nozzle passing through the ringed body, a heating medium contained in the combustion chamber. Particles of the heating medium blasted by the action of the nozzle from the lower part of the ringed body are circulated through the inner bore of the ringed body.

8 Claims, 4 Drawing Sheets

COMBUSTION APPARATUS AND METHOD OF FORCIBLY CIRCULATING A HEATING MEDIUM IN A COMBUSTION APPARATUS

BACKGROUND OF THE INVENTION

1. Field of the Invention

The present invention relates to a combustion apparatus and a method of forcibly circulating a heating medium in a combustion apparatus.

There have been known methods of combustion and combustion apparatuses in which a heating medium such as sand, gravel contained in a combustion chamber is mixed with fuel and the fuel is fired.

However, when low calorific oil fuel containing much water and other materials difficult to burn used for an oil fuel combustion apparatus, a fair amount of cinders is produced. It is difficult to burn the cinders themselves without using an auxiliary expedient for burning in the conventional methods and apparatuses. In recent years, low calorific oil fuel has been widely used. Treatment of the cinders, therefore, has become a big problem. Particularly, in ships equipped with an oil fuel combustion apparatus, disposal of the cinders has been controlled from the standpoint of contamination of the sea.

2. Summary of the Invention

It is an object of the present invention to provide a method and an apparatus capable of burning cinders and so on produced from low calorific oil fuel in which before introducing material to be burned into a combustion chamber, a heating medium for continuously heating the material to be burned at such a temperature that the material fires itself, is forcibly circulated by using gas for combustion.

According to the invention, a combustion apparatus includes an upright type combustion chamber having a bottom, conduity means extending below and along the bottom of the combustion chamber and having a nozzle which passes upwardly through the bottom and opens into the combustion chamber, a ringed body supported in the combustion chamber with a gap formed between the lower edge of the ringed body and the bottom of the combustion chamber, air blasted from the nozzle passing through the ringed body, a heating medium contained in the combustion chamber. Particles of the heating medium blasted by the action of the nozzle from the lower part of the ringed body are circulated through the inner bore of the ringed body.

DETAILED DESCRIPTION OF THE PREFERRED EMBODIMENT

Preferred embodiment of the present invention will be described with reference to accompanying drawing wherein.

Figure 1:
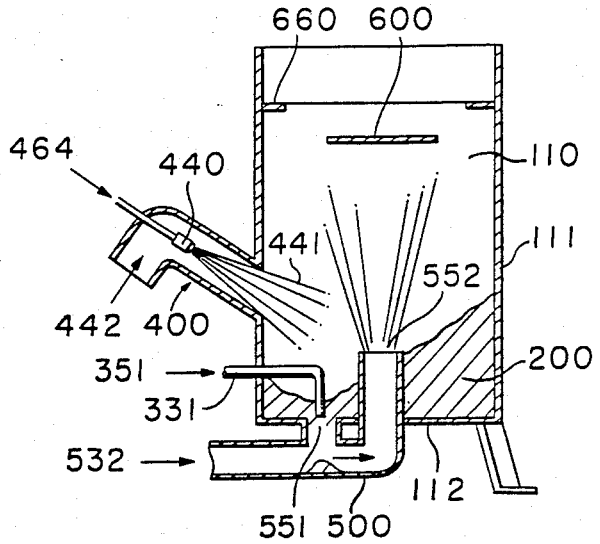
FIG. 1 is a longitudinal cross-sectional view of a first embodiment of the present invention.

The first embodiment for a forced circulation method and an apparatus for carrying out the method of the present invention will be described with reference to FIG. 1.

A combustion chamber 110 in which forced circulation of a heating medium is affected is defined by a side circumferential wall 111 and a bottom wall 112. The upper part of the combustion chamber may be covered by a suitable cover provided with an exhaust pipe. Alternatively, it is possible to connect the upper part of the combustion chamber to the corresponding part of another equipment so that heat energy produced in the combustion chamber is transmitted to the equipment which requires heat energy. A reference numeral 200 designates a heating medium such as sand, gravel, ceramic particles received in the combustion chamber 110 to burn solid fuel in a powdery or a particulate form, or liquid fuel. A numeral 331 designates a fuel supplying pipe for supplying the solid fuel or the liquid fuel into the combustion chamber, the fuel supplying pipe being generally provided at a proper position between an intake port 551 and a nozzle 552, both being described later and a numeral 400 generally designates a pilot burner means for heating the heating medium 200.

A conduit 500 which constitutes a part of a feeding means for feeding gas for combustion such as air is provided in the combustion chamber 110 so as to direct the nozzle 552 formed at an end of the conduit upwardly. The intake port 551 is formed in the bottom wall 112. to connect the combustion chamber with the conduit 500 extending laterally below the bottom wall 112 at a junction therebetween. However, it is possible that the conduit 500 is introduced in the combustion chamber through the side circumferential wall 111 of the combustion chamber and the intake port is formed at a part of the conduit extending laterally in the combustion chamber so that the opening of the intake port is directed upwardly.

In the combustion chamber having the construction as above-mentioned, when gas for combustion such as air is forcibly fed through the conduit 500, a part of the heating mediumm is sucked through the intake port 551 and is discharged from the nozzle 552 together with air. In this case, fuel such as A-type heavy oil, kerosine is fired by electric discharge in the pilot burner 440. The heating medium discharged from the nozzle 552 of the conduit is heated by flames 441 from the pilot burner or a hot gas produced by the pilot burner. Air is supplied through the pilot burner means 400 into the combustion chamber to spread the pilot flames and the hot gas in the combustion chamber. Depending on a sort of fuel, fuel may be supplied from the fuel supplying pipe after firing of the pilot burner to ignite the fuel thereby heating the heating medium.

The heating medium 200 heated by the pilot flames or the hot gas gradually falls and is finally sucked into the intake port 551 to be discharged in the combustion chamber 110 through the nozzle 552. By repeating the above-mentioned process, the heating medium reaches a predetermined high temperature. At the moment, liquid or solid fuel is put into the combustion chamber through the fuel supplying pipe 331. The fuel is introduced in the conduit from the intake port 551 together with the heating medium heated at a high temperature to be discharged into the combustion chamber through the nozzle 552. By repeating the process, the fuel is mixed with the heating medium at a high temperature to be heated thereby causing evaporation. Then, the fuel is fired by the pilot flames 441 or by natural ignition by the aid of the hot gas and the heating medium heated at a high temperature. Upon ignition of the fuel, the operation of the pilot burner is stopped.

Even after the operation of the pilot burner is stopped, the fuel is continuously supplied through the fuel supplying pipe 331 so that it is circulated through the conduit 500 along with the heating medium of a highly elevated temperature. As long as the fuel is fired even after the stoppage of the pilot burner, the heating medium accelerates evaporation of the fuel during the circulation of the heating medium and maintains combustion at good condition.

When air is supplied to the combustion chamber through the conduit, the heating medium 200 near the intake port 551 is introduced in the conduit due to the dead weight. Further, introduction of the heating medium into the conduit can be effectively and certainly carried out by rendering an inner pressure of the conduit 500 at the intake port 511 to be lower than a pressure in the combustion chamber.

Obstacle plates 600, 660 may be provided at suitable positions at the upper part of the combustion chamber. With the obstacle plates 600, 660, the heating medium 200 discharged upwardly from the nozzle 552 impinges on them and falls due to gravity and then is returned to the intake port 551 for circulation.

It is preferable that the opening of the fuel supplying pipe 331 faces the intake port 551 because the fuel and the heating medium fall in the conduit at an adequate proportion and are uniformly mixed while they are passed through the conduit together with the gas for combustion.

In the combustion apparatus as shown in FIG. 1, an amount of the heating medium 200 subjected to circulation can be controlled as desired by changing the size of the intake port 551 and a flow rate of air.

Figure 2:
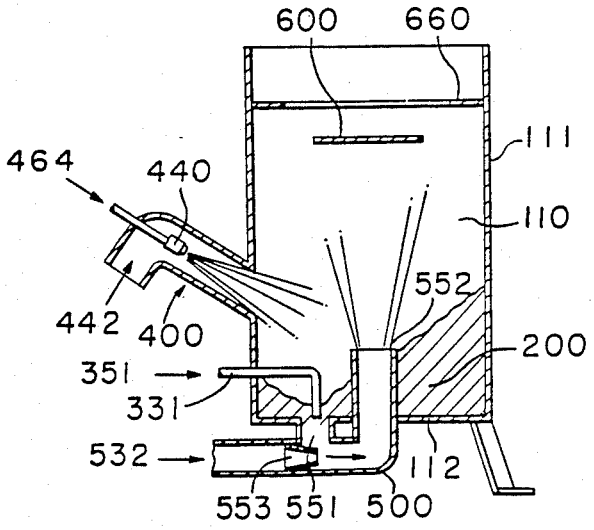
FIG. 2 is a longitudinal cross-sectional view of the combustion apparatus of a second embodiment of the present invention.

FIG. 2 shows the second embodiment of a forced circulation method and an apparatus for carrying out the method according to the present invention. In the second embodiment, a reduced aperture 552 nozzle is provided at the intake port 551 in the conduit 500. The nozzle renders a pressure in the conduit at the intake port to be lower than a presure in combustion chamber 110, whereby thus the resulting pressure difference effectively sucks the heating medium in the conduit. It is possible to place a partition plate, an inclined plate and so on to narrow the passage of the conduit, instead of the nozzle 553. Further, the intake port may be formed in the side wall of the conduit extending vertically in the combustion chamber instead of the intake port formed in the bottom wall of the combustion chamber. In this case, the same effect can be obtained.

Figure 3:
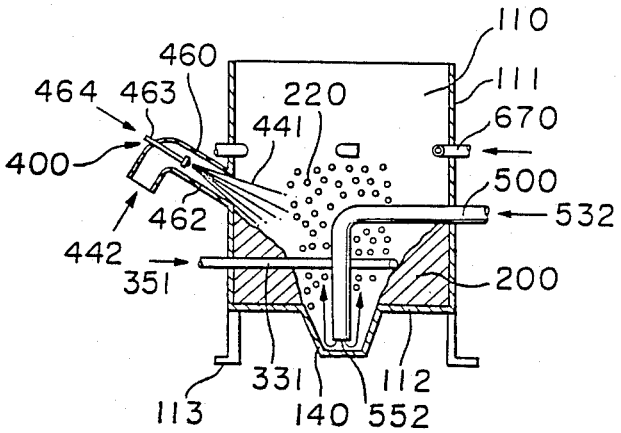
FIG. 3 is a longitudinal cross-sectional view of a third embodiment of the present invention.

The third embodiment of a forced circulation method and an apparatus for carrying out the method of the present invention will be described with reference to FIG. 3. In FIG. 3, the same reference numerals as in FIGS. 1 and 2 designate the same or corresponding parts and therefore, description of these parts is omitted. The nozzle 552' extends in the combustion chamber 110' downwardly so that the opening of the nozzle faces the bottom wall 112 of the combustion chamber 110' with a suitable gap. The nozzle is connected to the conduit 500' which extends into the combustion chamber by passing through the side circumferential wall 111 from the outside so that air 532 is fed through the conduit.

Near the lower central portion of the combustion chamber, a flow-regulating means 140 provided with an opened top, a side circumferential wall and a bottom wall is provided. A suitable gap is formed between the flow-regulating means 140 and the nozzle 552' so that discharged air is directed upwardly. The flow-regulating means may be in a cylindrical form or another form instead of an inversed frustum shape as shown in FIG. 3. In the FIGURE, the flow-regulating means is so formed as to be a part of the bottom wall of the combustion chamber. However, it is possible to construct a flow-regulating means separately and place it on the bottom wall. Thus, by providing the flow-regulating means at the lower part of the combustion chamber and by directing the opening of the nozzle into the flow-regulating means, the air discharged from the nozzle is effectively directed upwardly to increase the function of blowing-up of the heating medium.

Blades may be attached to the nozzle 552' or the inner side wall of the flow-regulating means 140 so that air goes upwards under swirling movement.

The fuel supplying pipe 331 is placed in the combustion chamber at a position away from the bottom wall to feed solid fuel in a powdery or a particulate form or liquid fuel. The top end portion of the pipe 331 is preferably in an annular shape surrounding the nozzle 552'. A plurality of apertures are formed in the end portion of the pipe so that fuel is supplied through the apertures.

A plurality of discharge openings 670 for secondary air for combustion are formed in the side wall of the combustion chamber near an opening 460 for directing pilot flame 441 to the combustion chamber, at an angle between the radial direction and the tangential direction to the center of the combustion chamber. An angle of elevation of the discharge openings is determined so as to produce a swirling air stream in the combustion chamber.

In the third embodiment, the same function of forcibly circulating the heating medium as the first and second embodiments can be obtained even though the direction of discharging of air is different from the first and second embodiments. Namely, the air ejected from the nozzle 552' hits the bottom wall of the combustion chamber or the flow-regulating means and is strongly raised upwardly, whereby the heating medium 200 is blasted upwardly.

In a case that discharge openings 670 for the secondary combustion air is formed in the side wall 111 of the combustion chamber, when supply of the air from the nozzle 552' is short for an amount of fuel supplied, air can be supplied from the discharge openings 670 to attain good combustion.

Heat produced in the combustion apparatus of the present invention can be finely and quickly controlled by adjusting supply of the fuel 351 to be fed into the combustion chamber through the fuel supplying pipe 331, or by adjusting an amount of air discharged from the nozzle 552' for blasting the heating medium, or by adjusting an amount of the secondary combustion air in case that the discharge openings 670 a provided.

Figure 4:
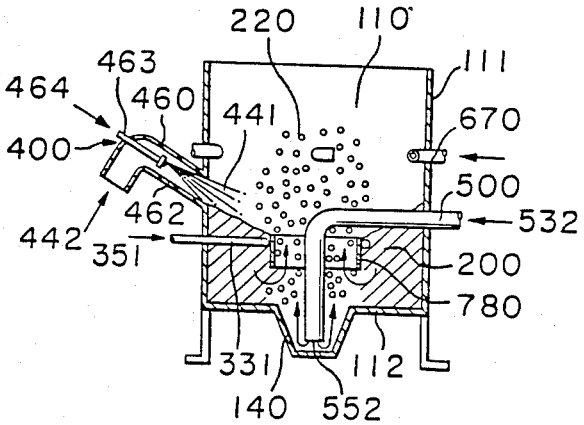
FIG. 4 is a longitudinal cross-sectional view of a fourth embodiment of the present invention.

FIG. 4 shows the fourth embodiment of a forced circulation method and an apparatus for carrying out the method according to the present invention.

The fourth embodiment is substantially the same as the third embodiment except that a ringed body 780 hvaing a side circumferential wall and openings at the top and the bottom is placed above the nozzle 552' and with a gap between the lower edge of the ringed body and the bottom wall of the combustion chamber. The shape of the ringed body 780 can be a desired form such as a cylindrical form, an inversed frustum shape. In FIG. 4, the upper part of the ringed body is surrounded by the annular part of the fuel supplying pipe 331. However, a positional relationship between them can be determined as desired.

In the operation of the combustion apparatus according to the fourth embodiment, since the heating medium 200 is blasted upwardly through the ring body 780, the heating media 200, 220 flow in the gap between the lower edge of the ringed body 780 and the bottom wall of the combustion chamber (or the upper end of the flow-regulating means 140). Namely, the blasted heating medium 220 is moved from the outside of the ringed body to the gap and is passed through the inside of the ringed body to be circulated. Accordingly, an amount of the heating medium to be circulated increases, hence the heat quantity of the heating medium increases whereby evaporation of the fuel is accelerated. In this case, further excellent combustion can be maintained even through unflammable material such as water is mixed in the fuel.

Figure 5:
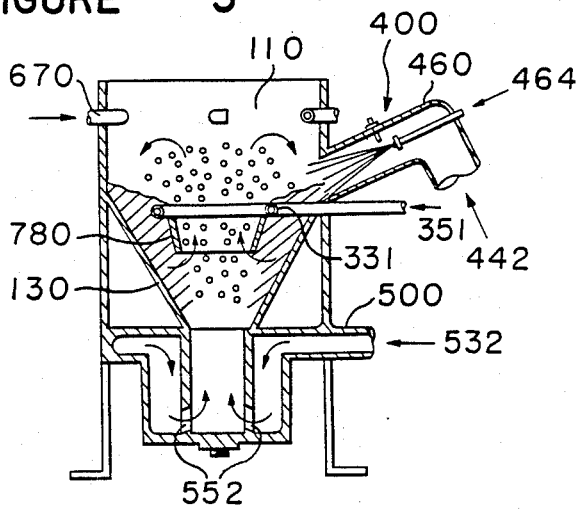
FIG. 5 is a longitudinal cross-sectional view of a fifth embodiment.

FIG. 5 shows the fifth embodiment of the combustion apparatus according to the present invention. In the fifth embodiment, the nozzle 552'' of conduit 500 extends laterally in the combustion chamber 110 to blast the heating medium upwardly, this constituting substantial difference from the first to the fourth embodiments. Further, the fifth embodiment is provided with a funnel-like slanting surface 130 attached to the lower part of the combustion chamber. The slanting surface 130 provides further effective circulation of the heating medium. The slanting surface 130 can also be provided in the first to fourth embodiments to attain the above-mentioned function.

Figure 6:
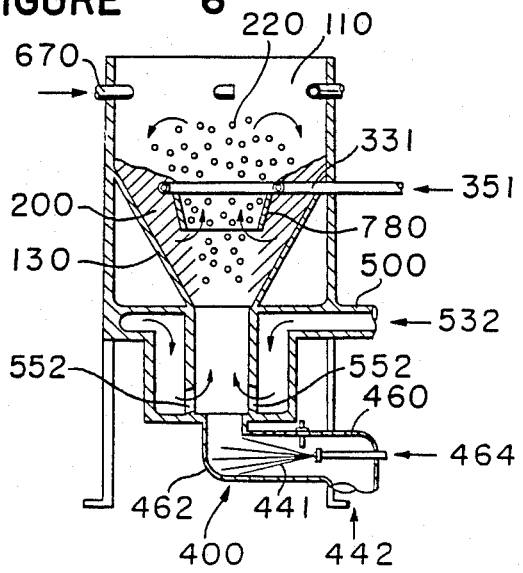
FIG. 6 is a longitudinal cross-sectional view of a sixth embodiment.

FIG. 6 shows the sixth embodiment of the combustion apparatus according to the present invention. The fundamental feature of the sixth embodiment is that the pilot burner means 400 including the pilot burner 460 and the opening 462 for guiding the pilot flames 441 or the hot gas in the combustion chamber is provided at the bottom of the combustion chamber. Further, the slanting surface 130 and the ringed body 780 may be placed as in the fifth embodiment.

The operation of the sixth embodiment will be described. When the heating medium 200 is blown upwardly by the air for combustion ejected from the nozzle 552'' the hot gas from the opening 462 is also directed upwardly together with the air, whereby the heating medium is heated from the lower part.

The seventh embodiment of a forced circulation method and a apparatus for carrying out the method according to the present invention will be described.

Figure 7:
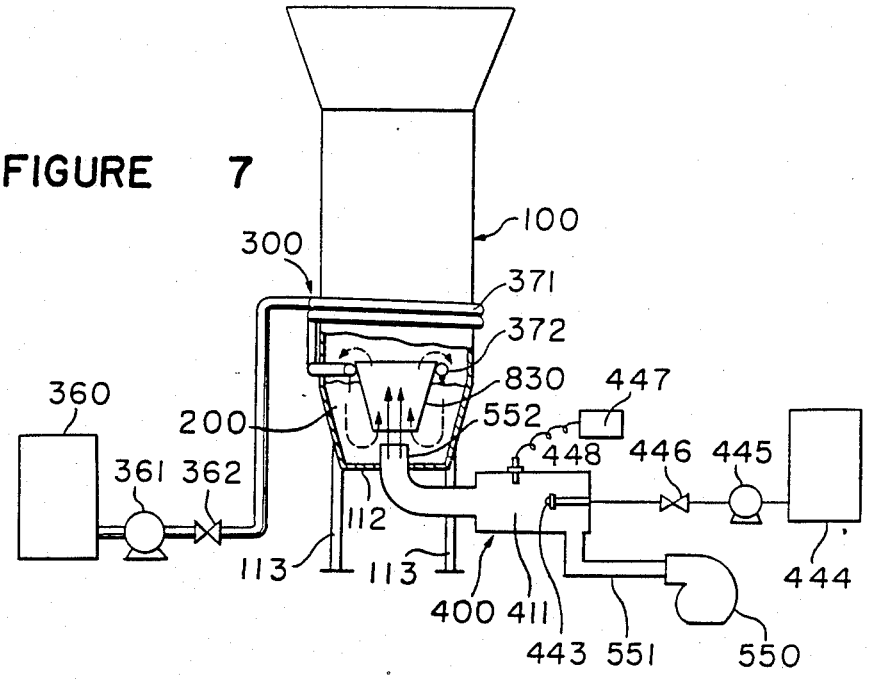
FIG. 7 is a diagram showing the entire system including the combustion apparatus according to a seventh embodiment of the present invention.

In FIG. 7, an annular diffuser 830 with its top and bottom opened is placed at the lower central portion in the combustion chamber and at a position away from the side wall and the bottom wall 112 of the combustion chamber. The diffuser mayhve a desired shape such as a cylindrical shape although it has an inversed frustrum shape in the FIG. 7. It is preferable that the upper end of the diffuser is located above the upper surface of the accummulated heating medium 200. The diffuser may be attached to the combustion chamber by means of legs connected to the bottom wall and radial arms connected to the side wall of the combustion chamber.

The pilot burner means for heating the heating medium at an initial stage, indicated by a numeral 400 as a whole, is provided with the nozzle 552'' which extends passing through the bottom wall 112 of the combustion chamber and has an opening. The opening faces the lower opening of the diffuser 800 with a suitable gap. The outer diameter of the opening is smaller than the inner diameter of the lower opening of the diffuser 830. Preferably, the shape of both the openings is circular and the axial lines of the both openings are aligned. A fuel spraying nozzle 443 is provided in the burning room 411 of the burner means 400 and the spraying nozzle 443 is communicated with a fuel tank 444 holding oil such as an A-type heavy oil, kerosine through a fuel supplying pump 445, a suitable valve means 446 and a pipe. An ignition plug 448 of an ignition device 447 is provided in the front of the spraying nozzle 443 in the burning room 411 to fire the fuel from the spraying nozzle 443. A pipe 511 for feeding air from a blower 550 is connected to the burning room 411 of the burner means 400. In this embodiment, the pipe 511 is connected to the burning room in the rear of the open end of the spraying nozzle, namely, on the right hand of the spraying nozzle in FIG. 7.

Condition for the operation of the combustion apparatus is so determined that an amount of air discharged from the blower is sufficient for combustion in the combustion chamber and the burning room; pressure around the nozzle 552'' is lower than that of the upper part of the combustion chamber when the air if blasted from the open end of the nozzle 552''' towards the combustion chamber; and the heating medium in the vicinity of the nozzle is blown upwardly, to thereby providing a cavity, whereby the heating medium is collected in the vicinity of the nozzle.

A numeral 360 designates a tank in which fuel including inflammable powdery and particulate material, inflammable fluid such as slush containing solid material hving a high ignition temperature and uninflammable fluid such as water is received. The tank is connected to the combustion chamber through a supplying means 300 inclusive of a pump 361 and a valve means 362 to supply the fuel on the heating medium 200. The supplying means 300 comprises a pipe 371 wound around the outer circumferential wall of the combustion apparatus 100 in a helical form and a circle portion surrounding the upper part of the diffuser 830 placed in the combustion chamber. A plurality of apertures are formed in the circle portion to eject the fuel on the heating medium 200.

The operation and function of the combustion apparatus of the seventh embodiment will be described.

Figure 8:
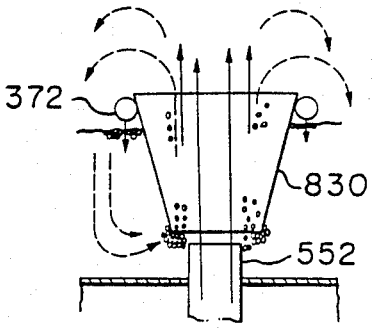
FIG. 8 is an enlarged front view of an important part of the seventh embodiment of the present invention.

A hot gas discharged from the nozzle 552''' is passed through the diffuser 830 facing the nozzle 552'''. In this case, presure in the vicinity of the lower opening of the diffuser 830 becomes higher than pressure at the outlet of the nozzle 552'' thereby resulting a pressure difference. Accordingly, the heating medium 200 is sucked in the diffuser 830 together with water and oil vaporized by heat of the heating 200 medium, due to the pressure difference. While the hot gas and heating medium are passed through the diffuser 830, the heating medium 200 is heated by the hot gas (FIG. 8). The heating medium 200 discharged from the upper opening of the diffuser 830 is accumulated on the heating medium outside the diffuser (as indicated by broken arrow marks in FIG. 8). Since the heating medium is sucked sequentially into the diffuser from its lower part, the heating medium is gradually heated by the hot gas during movement of circulation. The fuel is supplied on the heating medium 200 through the apertures formed in the circle portion 372 wound around the upper part of the diffuser. The fuel is mixed with the heating medium 200 and falls between the outer wall of the diffuser 830 and the inner wall of the combustion chamber together with the heating medium. In this case, water content in the fuel is vaporized by heat from the heating medium and the oil content in the fuel is gasified to be burned in the combustion chamber. The solid content in the fuel which has not been completely burned is subjected to movement of circulation together with the heating medium 200 and is repeatedly passed through the diffuser for burning.

In the first to the seventh embodiments, an exhaust pipe may be provided at the upper part of the combustion chamber. In this case, the position of the exhaust pipe is deflected laterally from the position of the nozzle at a suitable distance, whereby scattering of the heating medium can be prevented.

In accordance with the method and the apparatus for carrying out the method according to the present invention, solid or liquid fuel and a heating medium are heated and circulated in a combustion chamber by the action of air discharged from the blowing-up means. Accordingly, sufficient combustion can be obtained even though fuel containing uninflammable components e.g. heavy oil or lubricating oil containing about 70% of water is used. Further, adjustment of heat quantity produced in the combustion chamber is easy, whereby flexible operation can be attained for variation of a load. Accordingly, effective combustion can be obtained even when a load is small.

The combustion apparatus of the present invention is applicable not only to a heat source for a room warming apparatus or a water supplying apparatus which require heat energy but also to an incinerator. The combustion apparatus of the present invention is applicable to various fields.

We claim:

1. A combustion apparatus comprising:

an upright type combustion chamber having a bottom;

conduit means provided below said bottom of the combustion chamber and having a nozzle which is provided in or near the bottom of said combustion chamber;

means for introducing a fuel into said combustion chamber;

a ringed body supported in said combustion chamber at a such position that a gap is formed between the lower edge of said ringed body and the bottom of said combustion chamber, and air blasted from said nozzle is passed through said ringed body;

a heating medium contained in said combustion chamber; and pilot burner means for heating said heating medium, whereby particles of the heating medium blasted by the action of said nozzle from the lower part of said ringed body are circulated through the inner bore of said ringed body.

2. The combustion apparatus according to claim 1, wherein said nozzle opens at said bottom of said combustion chamber upwardly.

3. The combustion apparatus according to claim 1, wherein said nozzle is directed downwardly to open near said bottom of said combustion chamber.

4. The combustion apparatus according to claim 1, wherein said pilot burner means is provided at the side wall of said combustion chamber so that a flame is directed onto said heating medium.

5. The combustion apparatus according to claim 1, wherein said pilot burner means is provided in a conduit communicating with the bottom of said combustion chamber.

6. The combustion apparatus according to claim 1, wherein a funnel-like slanting surface is provided at the lower part of said combustion chamber.

7. A combustion apparatus comprising:

an upright type combustion chamber having a bottom;

combustion air conduit means provided below said bottom of the combustion chamber and having a nozzle which is provided in or near the bottom of said combustion chamber;

a ringed body supported in said combustion chamber at a such position that a gap is formed between the lower edge of said ringed body and the bottom of said combustion chamber, and air blasted from said nozzle is passed through said ringed body;

fuel supply means comprising a fuel supply pipe supporting said ringed body at a position above said nozzle; and a heating medium contained in said combustion chamber, whereby particles of the heating medium blasted by the action of said nozzle from the lower part of said ringed body are circulated through the inner bore of said ringed body.

8. The combustion apparatus according to claim 7 wherein said fuel supply pipe is annular, including a plurality of fuel discharge apertures formed along said annular fuel supply pipe.

* * * * *